United States Patent [19]

Beeson et al.

[11] 4,418,135

[45] Nov. 29, 1983

[54] THERMALLY-STABLE, INFRARED-SENSITIVE ZINC OXIDE ELECTROPHOTOGRAPHIC COMPOSITIONS ELEMENT AND PROCESS

[75] Inventors: Karl W. Beeson, Princeton; Himangshu R. Bhattacharjee; Frederick R. Hopf, both of Parsippany, all of N.J.

[73] Assignee: Allied Corporation, Morris Township, Morris County, N.J.

[21] Appl. No.: 421,703

[22] Filed: Sep. 22, 1982

[51] Int. Cl.[3] ..... G03G 5/05

[52] U.S. Cl. ..... 430/93; 430/945

[58] Field of Search ..... 430/91, 92, 93, 945

[56] References Cited

U.S. PATENT DOCUMENTS

| | | | |
|---|---|---|---|
| 2,952,536 | 9/1960 | Kurz | 96/1 |
| 2,957,765 | 10/1960 | Resetich | 96/1 |
| 3,345,162 | 10/1967 | McFarlane, Jr. et al. | 96/1.8 |
| 3,347,670 | 10/1967 | Nelson et al. | 96/1.5 |
| 3,378,370 | 4/1968 | Brancato | 96/1.8 |
| 3,540,886 | 11/1970 | Ansel et al. | 96/1.8 |
| 3,607,376 | 9/1971 | Blance | 117/155 |
| 3,615,419 | 10/1971 | Field | 96/1.8 |
| 3,619,154 | 11/1971 | Cavagna et al. | 96/1.7 |
| 3,682,630 | 8/1972 | Park | 96/1.6 |
| 3,745,006 | 7/1973 | Blance | 96/1.8 |
| 4,362,800 | 12/1982 | Takimoto et al. | 430/83 |

FOREIGN PATENT DOCUMENTS

| | | |
|---|---|---|
| 2046141 | 3/1972 | Fed. Rep. of Germany . |
| 57046245 | 5/1980 | Japan . |

OTHER PUBLICATIONS

J. P. Webb et al., IEEE J. Quant. Electr., QE-11, 40, 114, (1975).

Tappi, 56, 101, (1973), W. C. Park.

A. Stramondo, 1980 Proceedings of Lasers in Graphics, Electronic Publishing in the 80's Conference, vol. 1, p. I-27.

H. El-Amin, Plastics Technology, 27, 67, (1981).

*Primary Examiner*—John D. Welsh

*Attorney, Agent, or Firm*—James Riesenfeld; Gerhard H. Fuchs

[57] ABSTRACT

Electrophotographic compositions containing zinc oxide dispersed in a certain resin binder mixture and sensitized with a cyanine dye having a particular structure provide high sensitivity in the 780–840 nm wavelength range, excellent thermal stability, long dark decay time and near-white appearance. The compositions are particularly useful for non-transfer electrophotography and for electrostatic printing applications.

18 Claims, 1 Drawing Figure

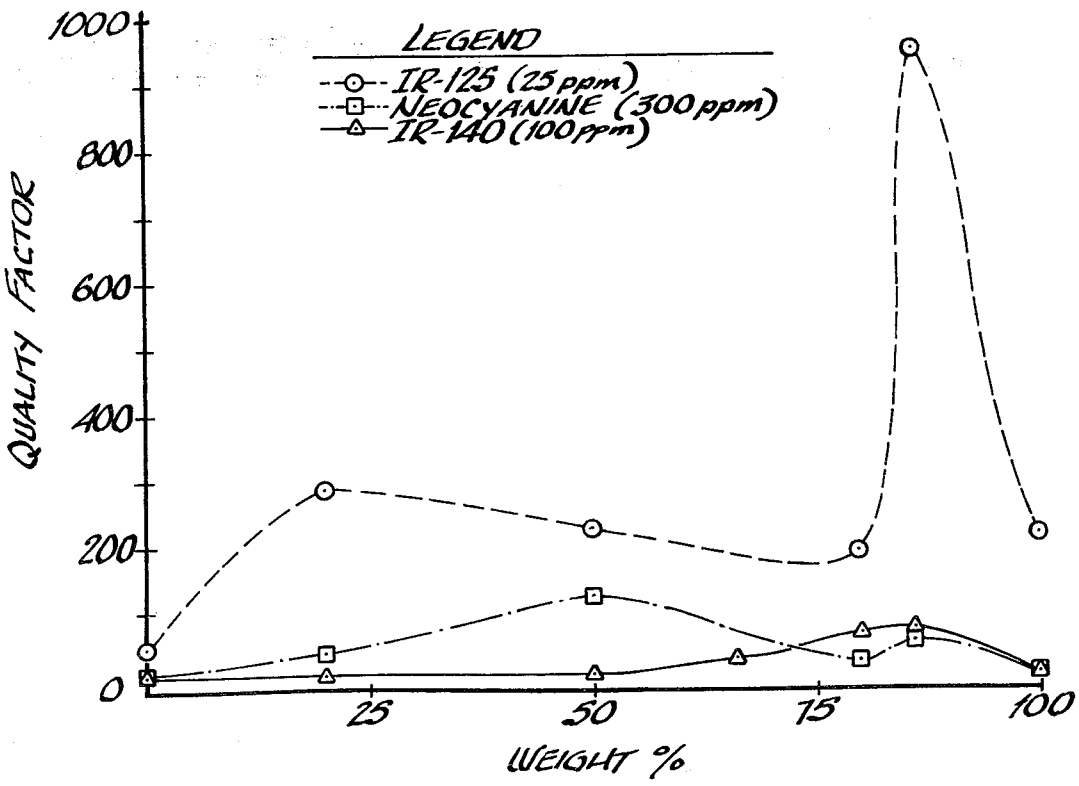
LEGEND
IR-125 (25 ppm)
NEOCYANINE (300 ppm)
IR-140 (100 ppm)
QUALITY FACTOR
1000
800
600
400
200
0
25
50
75
100
WEIGHT %

THERMALLY-STABLE, INFRARED-SENSITIVE ZINC OXIDE ELECTROPHOTOGRAPHIC COMPOSITIONS ELEMENT AND PROCESS

BACKGROUND OF THE INVENTION

1. Field of the Invention

This invention relates to photoconductive coating compositions and, more particularly, to dye-sensitized zinc oxide/resin binder compositions that have good thermal stability.

2. Description of the Prior Art

Electrophotography is an imaging process that typically involves placing a uniform charge on the surface of a photoconductor in the dark; imagewise exposing the charged photoconductor, thereby discharging it in the exposed areas; and applying to the surface a toner that is preferentially drawn to (or repelled from) the charged areas. To form a lasting image, the toner may then be fused on the surface or, alternatively, transferred to and fused on a receptor. Optionally, as is described in U.S. Pat. Nos. 2,952,536 and 2,957,765, treatment with a conversion solution containing, for example, ferrocyanide ions, can render toned and untoned areas oleophilic and hydrophilic, respectively, to provide a lithographic printing plate.

Photoconductive zinc oxide, dispersed in a resin binder, and, optionally, dye-sensitized is a well known system for electrophotography (see, e.g., R. M. Schaffert, *Electrophotography,* Focal Press, New York, 1973). Typically, a zinc oxide/resin binder system is coated on paper, and a toned image formed on its surface is fixed directly on the coating, without need to transfer the image to a receptor.

Resin binders suitable for use with zinc oxide in photoconductive compositions and, in particular, resin binder blends (or mixtures) have been disclosed in U.S. Pat. No. 3,345,162, issued Oct. 3, 1967, to S. B. McFarlane, Jr. et al.; U.S. Pat. No. 3,347,670, issued Oct. 17, 1967 to G. R. Nelson et al.; and U.S. Pat. No. 3,615,419, issued Oct. 26, 1971, to S. Field. Styrene acrylate resins as binders for photoconductive compositions are disclosed in U.S. Pat. No. 3,540,886, issued Nov. 17, 1970, to R. E. Ansel, et al. Vinyl acetate resin binders are disclosed in U.S. Pat. No. 3,378,370, issued Apr. 16, 1968, to S. T. Brancato; U.S. Pat. No. 3,607,376, issued Sept. 21, 1971 to R. B. Blance et al.; and U.S. Pat. No. 3,745,006 issued July 10, 1973 to R. B. Blance et al.

Among the dyes that have been found to be useful for spectral sensitization of zinc oxide are cyanine dyes. Cyanine dye-sensitization has been disclosed in U.S. Pat. No. 3,619,154, issued Nov. 9, 1971, to G. A. Cavagna et al. Similar dyes as sensitizers in thermally-stable, infrared-sensitive photoconductive compositions have been disclosed in Japanese Application (kokai) No. 7,046,245, published Mar. 16, 1982.

Zinc oxide electrophotographic coatings containing cyanine sensitizers and multicomponent binders were disclosed by W. C. Park in his U.S. Pat. No. 3,682,630, issued Aug. 8, 1972, and his paper-TAPPI, 56, 101 (1973).

The use of a laser diode as an exposure source for recording on electrophotographic material was disclosed by A. Stramondo in 1980 Proceedings of Lasers in Graphics, Electronic Publishing in the 80's Conference, Vol. 1, page 1–27.

SUMMARY OF THE INVENTION

In accordance with the present invention, we provide a photoconducting composition for use in electrophotography comprising photoconducting zinc oxide, a binder for the zinc oxide comprising a mixture of a styrene acrylate resin and a vinyl alkanoate resin, and a sensitizing dye selected from those having the general formula

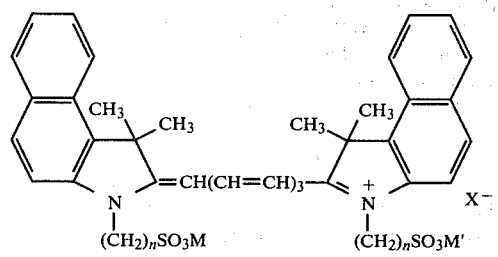

wherein n is an integer in the range between 1 and 7, M and M' are independently selected from the group consisting of hydrogen and the alkali metals, and X is an acid anion such as a halide or perchlorate. Preferably, n=4, M=Na, M'=H, and X=I.

In operation, we provide a process for preparing an electrophotographic image on a photosensitive sheet comprising the sequential steps of electrically charging the top surface of a sheet coated with a photoconducting composition of the type described above, imagewise exposing the sheet to a monochromatic beam of electromagnetic radiation, whose wavelength is in the range between about 780 and about 840 nm, and toning the sheet with an electrostatic toner to produce a toned image.

The photosensitive compositions of the present invention provide high sensitivity in the 780 to 840 nm wavelength range, excellent thermal stability, and long dark decay time, while having a desirable near-white appearance. In a preferred imaging process, the exposure source is a diode laser, which provides substantial advantages of low cost and simplicity over alternative sources.

BRIEF DESCRIPTION OF THE DRAWING

The FIGURE relates quality factor to dye and resin binder compositions of the present invention.

DETAILED DESCRIPTION OF THE INVENTION

The present invention provides zinc oxide electrophotographic coatings that have several advantages over those of the prior art and, in addition, provides a process for exposing the coatings with a diode laser or similar far-red/near-infrared radiation source.

Two factors, dark decay rate and photosensitivity, are important in the formulation of films for direct laser imaging. With relatively low output sources such as diode lasers, materials must have sufficient photosensitivity to produce high contrast images. Likewise, the surface potential of the material must remain sufficiently high during the entire imaging cycle (i.e., low dark decay rate) to insure uniform background quality. There is generally an inverse relationship between photosensitivity and dark decay time.

In order to quantify the related data on dark decay rates and photosensitivity, a quality factor, Q, is defined as the product of the dark decay time (time required for apparent surface potential to fall from −200 V to −100 V), and the sensitivity to 818 nm light (the reciprocal of the time required to reduce apparent surface potential from −100 V to −50 V during illumination with 818 nm light of about 0.54 $\mu W/cm^2$).

Compositions of the present invention use zinc oxide powder that is commercially available for electrophotographic applications. Typical of suitable material is Photox®-80, available from New Jersey Zinc Company. The other elements of the compositions are resin binder and sensitizing dye. The ratio of zinc oxide to binder is preferably in the range from about 4:1 to about 10:1, with 7:1 most preferred.

Dark decay rate and photosensitivity of zinc oxide coatings are strongly influenced by the characteristics of the resin binder. Polymeric resins commonly used in electrophotography include resins of the styrene acrylate type (exemplified by DeSoto-690-312) and resins of the vinyl alkanoate type (exemplified by Monsanto GMS-270T). We have discovered that for certain dyes, vinyl alkanoate resins provide excellent dark decay accompanied by poor optical sensitivity while styrene/acrylate resins show fair optical sensitivity with short decay times.

Surprisingly, for certain dyes, blends of styrene acrylate and vinyl alkanoate resins provide substantially higher quality factors than do either of the resins alone. In these blends, the styrene acrylate resin is preferably a copolymer having a percentage of styrene in the range from about 40–60%. This percentage and all others herein are by weight. The acrylate constituent may be an acrylate ester in which the R group has from 1–6 carbon atoms or it may be a mixture of such esters. Exemplary are methyl acrylate, ethyl acrylate, butyl acrylate, etc.

The vinyl alkanoate resin is preferably about 95% poly(vinyl alkanoate) in which the alkanoate or alkanoates have 2 to 8 carbon atoms; with the remainder comprising a mono-unsaturated mono- or di-carboxylic acid having 3 to 6 carbon atoms; a monoalkyl ester of a mono-unsaturated mono- or di-carboxylic acid, in which the acid has 3 to 6 carbon atoms and the alkyl group has 1 to 4 carbon atoms; or mixtures thereof. In a more preferred composition the poly(vinyl alkanoate) comprises poly(vinyl acetate): poly(vinyl butyrate) in a ratio of about 3:1; and the remainder comprises non-esterified or monoalkyl esters of maleic acid, fumaric acid, crotonic acid, or mixtures thereof.

Particularly good results are achieved with a blend of the above-mentioned DeSoto and Monsanto resins having a weight ratio in the range from about 3:1 to about 19:1 (75–95% DeSoto). A 6:1 ratio (86% DeSoto) is most preferred.

The extent of the advantage provided by blending varies with the particular dye that is used. A preferred dye of the present invention is indocyanine green (Ger. Offen. No. 2,046,141)—3,3,3',3'-tetramethyl-1,1'-di(4-sulfobutyl)-4,5; 4',5'-dibenzoindotricarbocyanine iodide, monosodium salt. It is commonly known as IR-125 and its structure is shown in Table I (Example 1). It has been disclosed as a laser dye (IEEE J. Quant. Electr., QE-11,40,114 (1975)).

The combined influence of binder and dye is shown in the FIGURE, which shows the effects of varying resin composition (weight % of DeSoto-690-312 in a mixture with Monsanto GMS-270T) on quality factors for three sensitizing dyes, IR-125, IR-140, and neocyanine. (The structures of these dyes, among others, are shown in Table 1 below). The FIGURE shows the excellent properties of IR-125 at a loading level of 25 ppm and also that both IR-140 and neocyanine are less effective sensitizing dyes, even at 100 and 300 ppm loading, respectively. Lower loadings (<100 ppm) of neocyanine decrease the photosensitivity to such an extent that even lower quality factors result. The FIGURE also shows that hybrid resin mixtures are more effective than the individual resins for all three sensitizing dyes at all loading levels and that IR-125 is a surprisingly efficient near-infrared sensitizing dye. Although dye loading of IR-125 in the range from about 1 to 300 ppm is suitable, dye loading of about 5 to about 25 ppm is preferred.

Since the environment of electrophotographic material is typically not controlled during shipping and storage and since temperatures of about 138° C. are used to dry films of electrophotographic material applied by commercial reverse roll coating, thermal stability is an important property of the dyes in these formulations. As is detailed in the examples below, tests were run comparing both the quality factor and thermal stability of IR-125 with that of seven other sensitizing dyes. IR-125 showed the highest quality factor; also, both long term (930 minutes/80° C.) and shorter term (210 minutes/140° C.) tests showed that IR-125 had superior thermal stability. Photochemical stability was less satisfactory. Exposure for an hour to laboratory light caused substantial degradation of IR-125.

The compositions of the present invention may be coated on a variety of substrates. Preferably, the substrate has resistivity less than about $10^9$ ohm-cm. Paper and aluminum are preferred, because they are both suitable and relatively inexpensive. Thermoplastic films having conductive coatings or additives are also suitable. Exemplary of a suitable material is poly(vinyl chloride) loaded with conductive carbon to provide resistivity in the desired range. Additional materials of this type are described in Plastics Technology 27, 67 (1981), and that disclosure is incorporated herein by reference.

Coating thickness of the composition tends not to be critical. Nominal coating thickness of about 50 $\mu m$ has been used successfully. If thickness is too low, charge acceptance is reduced, while high coating thickness is wasteful. Generally, coating thickness in the range from about 5 $\mu m$ to about 100 $\mu m$ is preferred. The compositions are preferably coated, dried, and stored in the dark to prevent degradation of the dye.

In use, the coating is charged, imagewise exposed, and toned. Optionally, the toner may be fixed to the surface. As is generally true with zinc oxide compositions, negative charge is preferred. Conventional toners, either liquid or powder, well known in the art, may be used. Diode lasers are a preferred exposure source, because they provide a high intensity beam that can be focused to a very small spot and because they are, compared to other lasers, relatively inexpensive. Diode lasers emitting in the wavelength range of 780–840 nm are well known and commercially available. Exemplary are AlGaAs laser diodes emitting at about 830 nm and available from Mitsubishi Electric Corp.

Beyond forming an image on a zinc oxide-coated sheet, the present invention also contemplates preparing a lithographic printing plate by first preparing a toned electrophotographic image on a coated sheet and then treating the surface with a conversion solution to render the toned areas oleophilic and the untoned areas hydrophilic. A preferred conversion solution contains ferrocyanide ions. For example, sodium- and potassium-ferrocyanide are suitable. The preferred electrophotographic compositions for printing plates have different characteristics from those intended for use in non-transfer imaging. For example, printing plates must be sufficiently durable to permit multiple copies to be prepared, but their electrophotographic coating need not be white.

The following examples are presented in order to provide a more complete understanding of the invention. The specific techniques, conditions, materials, and reported data set forth to illustrate the principles and practice of the invention are exemplary and should not be construed as limiting the scope of the invention.

EXAMPLES 1-8

Zinc oxide-resin binder compositions were prepared as follows:

7:1 zinc oxide (Photox-80):total resins (6:1 DeSoto-690-312:Monsanto GMS-270T) with 300 ppm dye were first ground in a Waring blender to a Hegman gauge fineness of 4-6. Blending temperatures were kept below 60° C. Samples were drawn down with a No. 24 Mayer rod on 0.15 mm thick anodized aluminum in diffuse room light and air dried at room temperature in a darkened hood for 24 hours. Samples were then cut to the proper size for measurements and covered to exclude light. The samples were conditioned at least 24 hours at about 22° C. and 50% relative humidity. The dyes used for the various examples are shown in Table 1.

Quality factors for each coating were determined by the dark decay rate and sensitivity to 818 nm exposure and are shown in Table 2. We note that the coating sensitized with IR-125, a dye of the present invention, shows the highest quality factor, even though its loading was 25 ppm, compared with 300 ppm for the other dyes.

Thermal stability for each coating was studied by monitoring changes in reflectance spectra. The procedure used was as follows: reflectance spectra of the coatings were recorded after conditioning but before any heating. Light-protected samples were then placed in thermostatically controlled ovens (±0.5° C.) and subjected to repeated cycling between ambient relative humidity and temperature (about 30-65%/21-23° C.) and 80° C. for various time intervals. Degradation of the dye was monitored by reflectance spectrophotometry. The relative absorbance, $A/A_o$ (absorbance after a specific period of heating at a particular temperature/absorbance before any heating), of samples gives a quantitative indication of relative amounts of dye remaining.

Table 2 tabulates $A/A_o$ for the eight compositions after heating for a total of 930 minutes at 80° C. This allows direct comparison of thermal stabilities for the eight dyes. All samples except those containing IR-125 showed degradation. Formulations of IR-125 were stable under these conditions for up to $1.4\times10^4$ minutes at 80° C. Table 2 also tabulates absorbance changes produced by exposure to 140° C. for 30 and for 210 minutes. Note that after 210 minutes at 140° C. all of the cyanine dyes except IR-125 were completely destroyed.

TABLE 1

| Example | Common Name | Absorp. Max. (nm) | Structure |
|---|---|---|---|
| 1 | IR-125 | 806 | 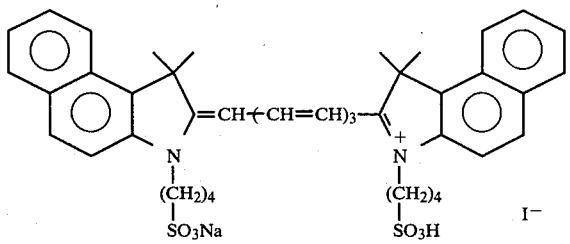 |
| 2 | IR-132 | 840 | 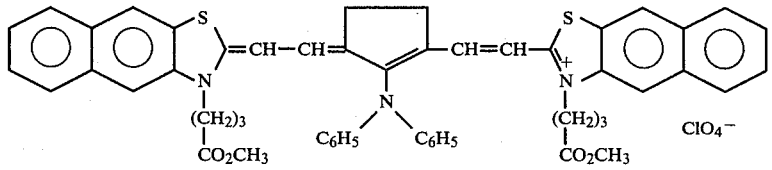 |
| 3 | DQTC, Iodide | 832 | 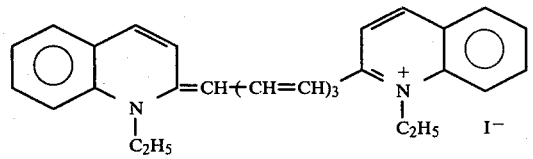 |

TABLE 1-continued

| Example | Common Name | Absorp. Max. (nm) | Structure |
|---|---|---|---|
| 4 | IR-140 | 828 | 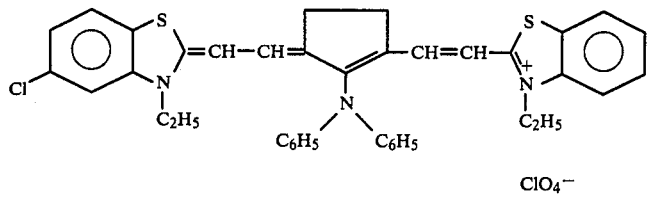 |
| 5 | 11-Bromo-DQDC, Iodide | 810 | 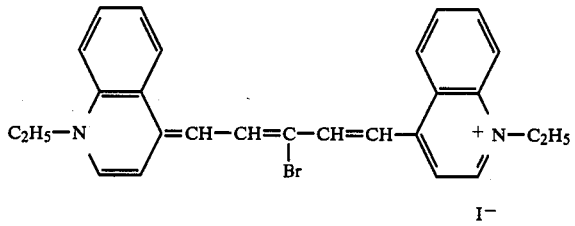 |
| 6 | HDITC, Perchlorate | 800 | 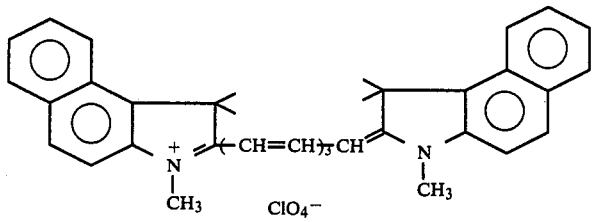 |
| 7 | Neocyanine, Diiodode | 787 | 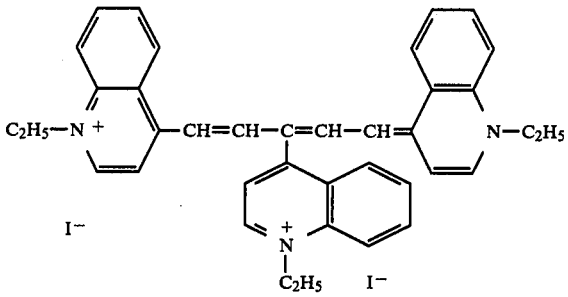 |
| 8 | DTTC. Iodide | 772 | 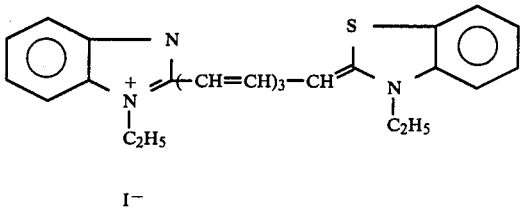 |

TABLE 2

| Example | Dye (300 ppm) | Quality Factor, Thermal Stability Q | A/A$_o$ 930 min 80° C. | 30 min 140° C. | 210 min 140° C. |
|---|---|---|---|---|---|
| 1 | IR-125 | 955* | 1.0 | 1.0 | 1.0 |
| 2 | IR-132 | 447 | 0.05 | 0 | 0 |
| 4 | DQTC, Iodide | 162 | 0.10 | 0 | 0 |
| 4 | IR-140 | 624 | 0.65 | 0.45 | 0 |
| 5 | 11-Bromo-DQDC, Iodide | 105 | 0.55 | 0.50 | 0 |
| 6 | HDITC, Perchlorate | 532 | 0.81 | 0.66 | 0 |
| 7 | Neocyanine, Diiodide | 232 | 0.83 | 0.82 | 0 |

TABLE 2-continued

| Example | Dye (300 ppm) | Quality Factor, Thermal Stability Q | A/A$_o$ 930 min 80° C. | 30 min 140° C. | 210 min 140° C. |
|---|---|---|---|---|---|
| 8 | DTTC, Iodide | 198 | 0.30 | 0 | 0 |

*25 ppm dye loading

We claim:

1. A photoconducting composition for use in electrophotography comprising:

(a) photoconducting zinc oxide, (b) a binder for the zinc oxide comprising a mixture of a styrene acrylate resin and a vinyl alkanoate resin, and (c) a sensitizing dye selected from those having the general formula

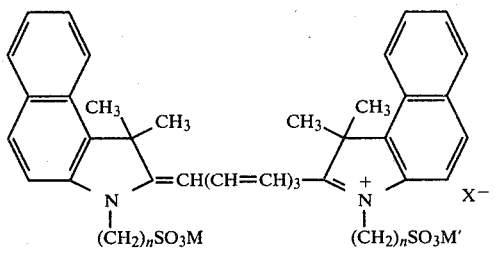

wherein n is an integer in the range between 1 and 7, M and M′ are independently selected from the group consisting of hydrogen and the alkali metals, and X is an acid anion.

2. The composition of claim 1 in which the styrene acrylate resin is about 50:50 styrene:alkyl acrylate.

3. The composition of claim 1 in which the vinyl alkanoate resin is about 95% poly(vinylalkanoate) in which the alkanoate or alkanoates have 2 to 8 carbon atoms and the remainder comprises a mono-unsaturated mono- or di-carboxylic acid having 3 to 6 carbon atoms; a monoalkyl ester of a mono- or di-carboxylic acid, in which the acid has 3 to 6 carbon atoms and the alkyl group has 1 to 4 carbon atoms; or mixtures thereof.

4. The composition of claim 3 in which the poly(vinyl alkanoate) comprises poly(vinyl acetate):poly(vinyl butyrate) in a ratio of about 3:1; and the remainder comprises non-esterified or monoalkyl esters of maleic acid, fumaric acid, crotonic acid, or mixtures thereof.

5. The composition of claim 1 in which n equals 4.

6. The composition of claim 1 in which M is Na and M′ is H.

7. The composition of claim 1 in which X is I.

8. The composition of claim 1 in which n equals 4, M is Na, M′ is H, and X is I.

9. The composition of claim 8 in which the dye is present in an amount less than about 50 ppm.

10. A photosensitive sheet comprising a substrate having a surface that is coated with the composition of claim 1.

11. The photosensitive sheet of claim 10 in which the substrate has a resistivity less than about $10^9$ ohm-cm.

12. The photosensitive sheet of claim 10 in which the substrate is paper.

13. The photosensitive sheet of claim 10 in which the substrate is aluminum.

14. The photosensitive sheet of claim 10 in which the substrate is poly(vinyl chloride) loaded with conductive carbon.

15. A process for preparing an electrophotographic image on a photosensitive sheet comprising the sequential steps of:

(a) electrically charging the coated surface of the photosensitive sheet of claim 10, (b) imagewise exposing the photosensitive sheet to a beam of electromagnetic radiation whose wavelength is in the range between about 780 and about 840 nm, and (c) toning the sheet with an electrostatic toner to produce a toned image.

16. The process of claim 15 wherein the beam of radiation is provided by a diode laser.

17. A process for preparing a lithographic printing plate comprising the process of claim 15 followed by treating the surface with a conversion solution, whereby the toned image becomes oleophilic and the untoned areas of the surface become hydrophilic.

18. The process of claim 17 in which the conversion solution comprises ferrocyanide ions.

* * * * *